US005125334A

United States Patent [19]

Marx et al.

[11] Patent Number: 5,125,334

[45] Date of Patent: Jun. 30, 1992

[54] SHEET-FED PRINTING MACHINE FOR MULTI-COLOR PRINTING HAVING ADJUSTABLE GRIPPER CARRIAGES

[75] Inventors: Karl Marx, Augsburg; Ingo Kobler, Anhausen; Erich Wegel, Mühlheim/Main; Rudolf Melzer, Hainburg; Valentin Gensheimer, Mulhlheim/Main; Georg Hartung, Augsburg; Bert Cappel, Mühlheim/Main, all of Fed. Rep. of Germany

[73] Assignee: MAN Roland Druckmaschinen AG, Fed. Rep. of Germany

[21] Appl. No.: 608,222

[22] Filed: Nov. 2, 1990

[30] Foreign Application Priority Data

Nov. 2, 1989 [DE] Fed. Rep. of Germany ..... 3936345

[51] Int. Cl.[5] ..... B41F 3/42

[52] U.S. Cl. ..... 101/183; 101/408; 271/206; 271/277

[58] Field of Search ..... 271/206, 277; 101/177, 101/183, 408–410

[56] References Cited

U.S. PATENT DOCUMENTS

| | | | |
|---|---|---|---|
| 2,138,405 | 11/1938 | Huck | 271/206 X |
| 2,756,995 | 7/1956 | Koch | 271/206 X |
| 2,775,934 | 1/1957 | Luehrs et al. | 271/206 X |
| 3,109,644 | 11/1963 | Reinartz | 271/206 |
| 3,413,732 | 12/1968 | Koch et al. | 271/206 X |
| 3,949,670 | 4/1976 | Katsuji | 101/183 X |
| 4,852,491 | 8/1989 | Holl et al. | 101/408 |

FOREIGN PATENT DOCUMENTS

| | | | |
|---|---|---|---|
| 1224753 | 9/1966 | Fed. Rep. of Germany | 101/408 |
| 191512 | 1/1923 | United Kingdom | 271/206 |

*Primary Examiner*—Joseph E. Valenza
*Assistant Examiner*—Boris Milef
*Attorney, Agent, or Firm*—Leydig, Voit & Mayer

[57] ABSTRACT

In order to improve mechanical positive synchronization in a sheet-fed printing machine between gripper carriages guided in wave-like fashion through printing units on endless chains and the associated impression cylinder, the impression cylinders (1) have twice the diameter of the plate and blanket cylinders (2, 3). Sprocket wheels (34), also of twice the diameter of the blanket cylinders, are fixed on the ends of the double-size impression cylinders (1) and on them there are disposed two diametrically opposite gripper carriage locating and fixing devices (24–32) which are adjustable both radially and tangentially and which can also be used to bring the different printing plates into register with one another on the printed sheet (38).

6 Claims, 3 Drawing Sheets

SHEET-FED PRINTING MACHINE FOR MULTI-COLOR PRINTING HAVING ADJUSTABLE GRIPPER CARRIAGES

FIELD OF THE INVENTION

The invention relates to a sheet-fed printing machine for multi-colour printing.

BACKGROUND OF THE INVENTION

A sheet-fed printing machine of such type is disclosed in U.S. Pat. No. 2,138,405. The chain-guided gripper carriages provided to transport the sheet through the printing machine in a single gripper closure are intermittently locked to the impression cylinders of the printing units in order to synchronize the circumferential speeds of the cylinder surfaces and of the chains and of the guide rails connected to the latter. This is one of the most important requirements for good register for perfect multi-colour printing.

To obtain good register, very accurate operation also is required in the reproduction, stage through assembly up to the plate copy. In some cases, special register systems are used and special coloured assembly sheets are copied for assembly in order to facilitate the process. Setting up a printing job, however, largely comprises bringing the various printing plates into register with one another on the printed sheet. To obtain good register, therefore, the printing plates must be carefully clamped, for which purpose the plates bearing the test for printing are immovably clamped on the cylinders which carry said plates in order to align them so that they are in register. This, however, is a very time-consuming and difficult operation particularly if the printing plate is clamped in a skewed position, i.e., with the start of the print not parallel to the axis of the plate cylinder, or if any adjustment errors or inaccuracies which may occur at the reproduction stage from assembly up to the plate copy require compensation.

Irregularities occur in sheet-fed printing machines because of elongation of the gripper carrying chains during operation. For example, stretching and elongation or contraction of the chains cause difficulties resulting in disturbances to the effective operation between the gripper on the chains and the grippers from which the sheets are received, such as a feed drum. Radial or vertical positioning of the grippers relative to the direction of their travel through the machine may also be disturbed due to uneven chain lengths. Dynamic loading occurs due to speed changes in the chains which are guided in wave-like fashion through the sheet-fed printing machine, the gripper carriages which are suspended therefrom being guided over parabolic guide rails within and outside the cutout of each impression cylinder, and such dynamic loading has an adverse effect on register. This particularly occurs because non-adjustable mechanical synchronization means are provided in the form of positive fixing devices which close automatically during operation, and this results in deterioration of synchronization of the circumferential speeds of the surfaces of the impression cylinders and of the chain-guided gripper carriages or the parabolic or like guide rails coupled thereto.

The textbook "Einfuhrung in den Offsetdruck", by Wolfgang Walenski, Eggen-Fachbuchreihe, 1975, page 113, shows a sheet-fed printing machine having a double-size impression cylinder and double-size take-off and transfer drums with correspondingly large sprocket wheels, in which it is known that the transfer of the sheets from the first printing unit to the second can be carried out by chain-guided gripper systems using two special locking systems disposed diametrically opposite one another on the double-size drums, the gripper systems being adjustable both radially and tangentially for exact transfer. The special locking system is controlled intermittently so that the sheets are transferred to the double-size take-off drum or are transferred from the latter to the grippers of the delivery unit only when the printing is completed, even in the case of a maximum format. It is a disadvantage that two sheet transfers occur between the printing units, and register differences may occur due to transfer difficulties.

OBJECT AND SUMMARY OF THE INVENTION

The object of the invention is to improve the mechanical positive synchronization between the gripper system, on the one hand, and the associated impression cylinder, on the other hand, in a sheet-fed printing machine.

The invention has a number of advantages. Firstly, the printed sheets are transported between the printing units in a single gripper closure. Since there is no need for a plurality of gripper closures for the sheet transport, the transfer difficulties and accompanying register differences resulting therefrom cannot occur from the outset, although they can be found in printing machines with chain-guided gripper systems between the individual printer units. There is surface contact of the sheet in the region of the printing zone at the impression cylinder, the angle at which the printed sheet is drawn off always being the same up till complete printing even of a sheet having the maximum format. Thus the known difficulties, such as curling of the sheet at the end thereof, mackling and register differences at the sheet end, do not occur even when firmly adhering sheet formats are released from the blanket of a blanket cylinder preceding the impression cylinder. The start of the sheet does not leave the periphery of the impression cylinder until completely printed. The torque can be transmitted to each individual printing unit via a continuous longitudinal shaft driven by the main motor, the transmission being statically determinate, while the chain drive can be regarded as a decoupling of the printing units so that the difficulties of mechanical positive synchronization between the sheet-fed cylinders and the drums such as occur with a continuous wheel transmission, do not apply. Also, the risk of smearing is reduced due to the elimination of transfer drums and there are better possibilities for drying freshly printed sheets. Also there are less effects on the cylinders due to fewer gripper shaft controls with a cam for opening and closing the gripper systems. Moreover, the gripper architecture, i.e., the lateral arrangement of the grippers, can be closer, and in addition to better register accuracy, this also results in higher transmissible forces on release of the sheet from the blanket cylinder. Finally, thickness differences in the materials being printed (thin paper as compared with cardboard) are less marked as regards gripper impact in the case of a single transfer from the feed to the chain, than would be the case with a plurality of transfers conventional in other chain-guided gripper systems, i.e., there is no need to adjust the height of the numerous carriages or drums to the corresponding paper thickness in order to avoid register inaccuracies due thereto. The machine speed can also be increased.

Other objects and advantages of the invention will become apparent upon reading the following detailed description and upon reference to the drawings, in which:

Figure 1:
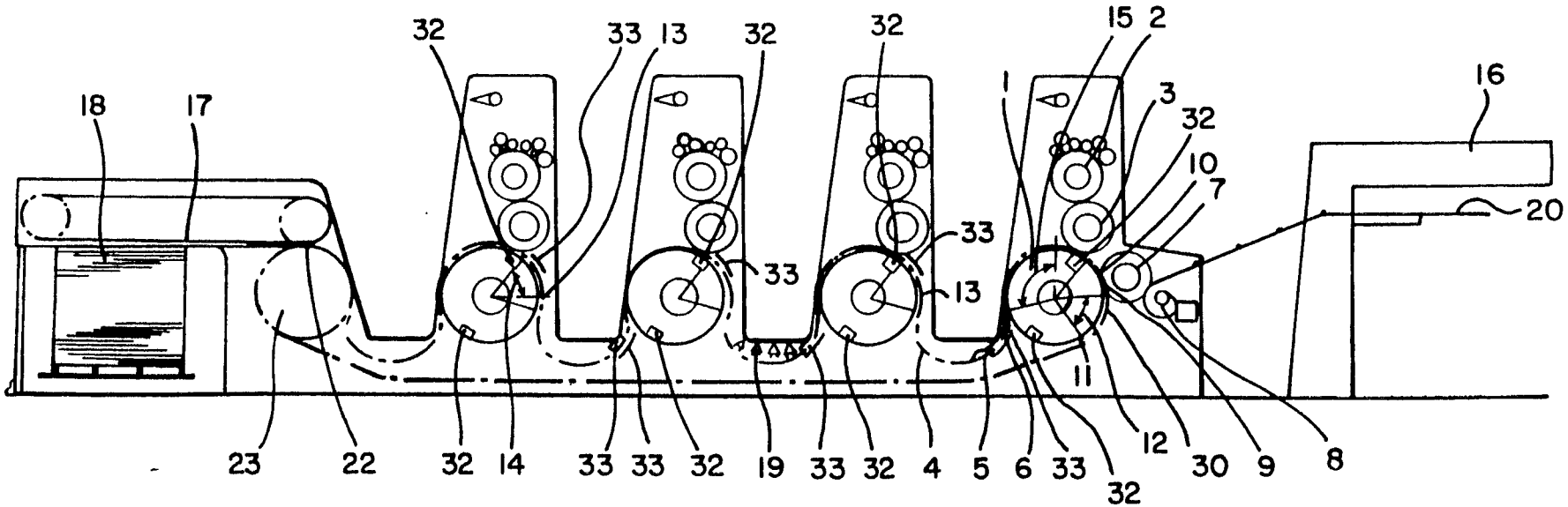
FIG. 1 is a side elevation view of a sheet-fed printing machine in which the sheet is moving wave-fashion through the printing units in one gripper closure by means of chain-guided gripper carriage in accordance with the invention.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DESCRIPTION OF THE PREFERRED EMBODIMENT

Turning now more particularly to the drawings, there is shown an illustrated sheet-fed printing machine having a chain-guided sheet transfer system in accordance with the present invention. The printing machine comprises a plurality of printing units each consisting of a plate cylinder 2, a blanket cylinder 3, and an impression cylinder 1 which is twice the diameter of the blanket cylinder. Sprocket wheels 34, also twice the size of the blanket cylinder 3, are fixed at the ends of the impression cylinder 1 and engage endless chains 4 which are moved in wave-like path through the printing units as illustrated. Gripper carriages 5 are fixed to the chains and are guided around the impression cylinder of each successive printing unit. The gripper carriages 5 in this instance are supported by the chains 4 by means of carrier links 35. The gripper carriages 5 each comprise a gripper support 40 supported for movement with the chain link 35 by a carrier rod 37 and a gripper finger 39 supported by a carrier rod 36 for pivotal movement between a clamping position in which the end of the sheet is interposed between the gripper support 40 and finger 39 and a sheet-releasing position pivotally removed from the gripper support 40.

In accordance with the invention, carrier locating and fixing means are provided for precisely locating the carriers in predetermined radial and tangential relation to each impression cylinder during transfer about the impression cylinder. To this end, the plate carrier locating and fixing means comprises radially and tangentially adjustable carriage locating and fixing devices 24-32 carried by the bracket wheels 34. Since two sheets circulate about each impression cylinder, and thus the sprocket wheel 34, two fixing devices 24-32 are provided on diametrically opposed sides of each sprocket wheel 34.

The fixing devices 22-32 each include a prism or cradle 25 that is mounted on the sprocket for peripheral adjustment between a circumferentially oriented set screw 31 supported in upstanding flange 29 of the sprocket wheel 34 and a spring 30 interposed between the opposite side of the prism and an abutment **29*a* of the sprocket wheel 34. The prism 25 defines an outward V-shaped opening adapted for receiving a support roller 22 carried by the carrier link 35 beneath the carrier rod 36 for the gripper finger 39 of the respective gripper carriage 5 for precisely locating the forward end of the gripper carrier link 35. At such position, the link 35 also is positionable against an alignment surface 27 disposed beneath a carrier rod 37 of the gripper supports 40 of the gripper carriages 5. For precisely adjusting the radial position of the support surface 27, which in this case is defined by a substantially rectangular block, a radially extending support screw 28** is provided on the underside thereof.

At the carrier link locating position established by the prism 25 and alignment surface 27, the sprocket wheel is devoid of teeth for a sufficiently long circumferential length for receiving the link 35 and the adjoining areas, which coincides with the cylindrical cut-out in the impression cylinder. As a result, the tensile load of the chain 4 is suspended from the link 35 before and after passing the cylinder cut-outs in the impression cylinder.

For positively pulling the carrier link 35 radially inwardly so that the support roller 24 at the forward end of the link is firmly located within the prism 25 and the rear portion of the link is firmly located on the alignment surface 27, an electromagnet 32 is provided on the sprocket wheel 34 at a location intermediate the prism 25 and the alignment surface 27. The electromagnet 32 may be energized in timed sequence with rotation of the sprocket wheel 34 and impression cylinder 1 for exerting a positive pulling force on the link 35 when positioned within the toothless area of the sprocket wheel, thereby precisely locating the link 35, the carriage support 40 and the gripper finger 39 with respect to the impression cylinder. The leading end of the sheet is thus properly located and may be so retained during printing.

In operation of the printing machine, as shown in FIG. 1, a sheet 38 is guided in known manner from the feeder 16 over the feed table 20 and is appropriately aligned at the front and sides when stationary. Swinging front grippers 8 pass the sheet with accelerating movement to a uniformly rotating feed drum 7 that transfers the sheet at 10 to the gripper carriage 5, which is selectively located relative to the impression cylinder for the sheet transfer at point 10. The gripper carriage 5 with the front edge of the completely printed sheet 38 leaves the periphery of the impression cylinder 1 of the first printing unit at point 6 and is re-aligned jointly from point 13 onwards on the impression cylinder 1 of the second printing unit.

During running of the machine in which the printed side of the sheet experiences no mechanical contact whatsoever, the fresh ink can be dried by means of a drying device 19. After the last printing, the sheet 38 is transferred at point 22 to the chain circle 17 by the delivery drum 23 and is delivered in the form of a stack 18.

With further reference to FIG. 1, reference 12 denotes the angle available for alignment and fixing of the gripper carriages in the first printing unit. Reference 13 is the tangent point of the chain 4 for aligning and fixing the gripper carriages in the following printing unit. Reference 14 denotes the angle available for alignment and fixing of the carriages in the following printing unit, while reference 15 denotes the angle corresponding to the maximum sheet size.

The available angles 12 and 14 for alignment and fixing of the gripper carriages 5 on the impression cylinder 1 are utilized by passing the gripper carriages 5 or gripper chain 4 over a path outside the periphery of the sprocket wheel 34 of the impression cylinder 1 so that they pass between the printing units with substantially no shock and the minimum inertia forces, e.g., by being guided parabolically in guide rails 33. The guide rails 33 which are constructed to be parabolic or according to some other exponential function produce centrifugal forces which act on the gripper carriages 5 during operation of the machine and which can be selected in any ratio progressively increasing or decreasing from zero to a constant value at the point of contact with the periphery of the double-size impression cylinder 1, this being possible by the construction of the guide track.

Figure 2:
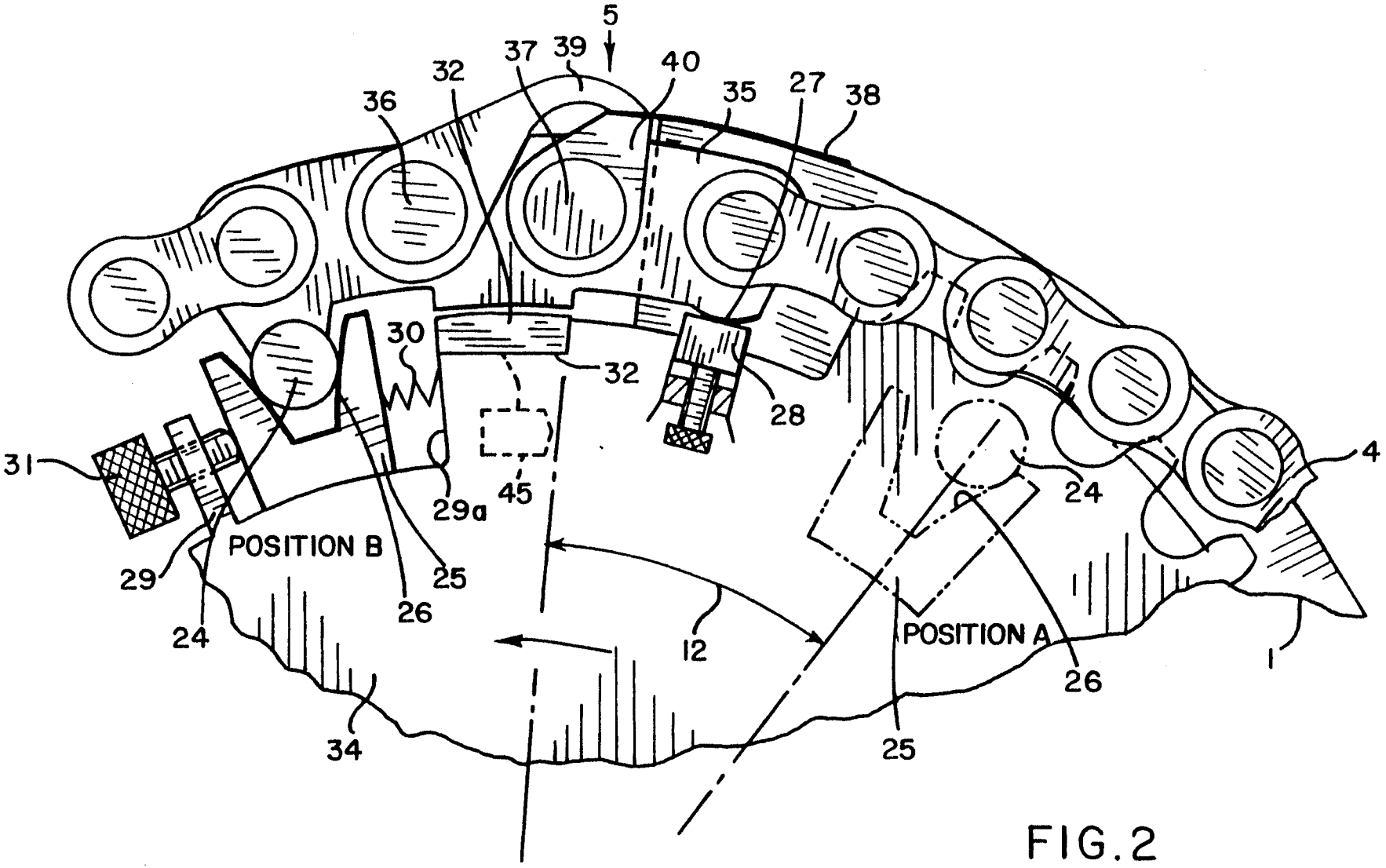
FIG. 2 shows a gripper carriage that is intermittently lockable to the impression cylinder of the successive printing units of the sheet-fed machine shown in FIG. 1.
Figure 3:
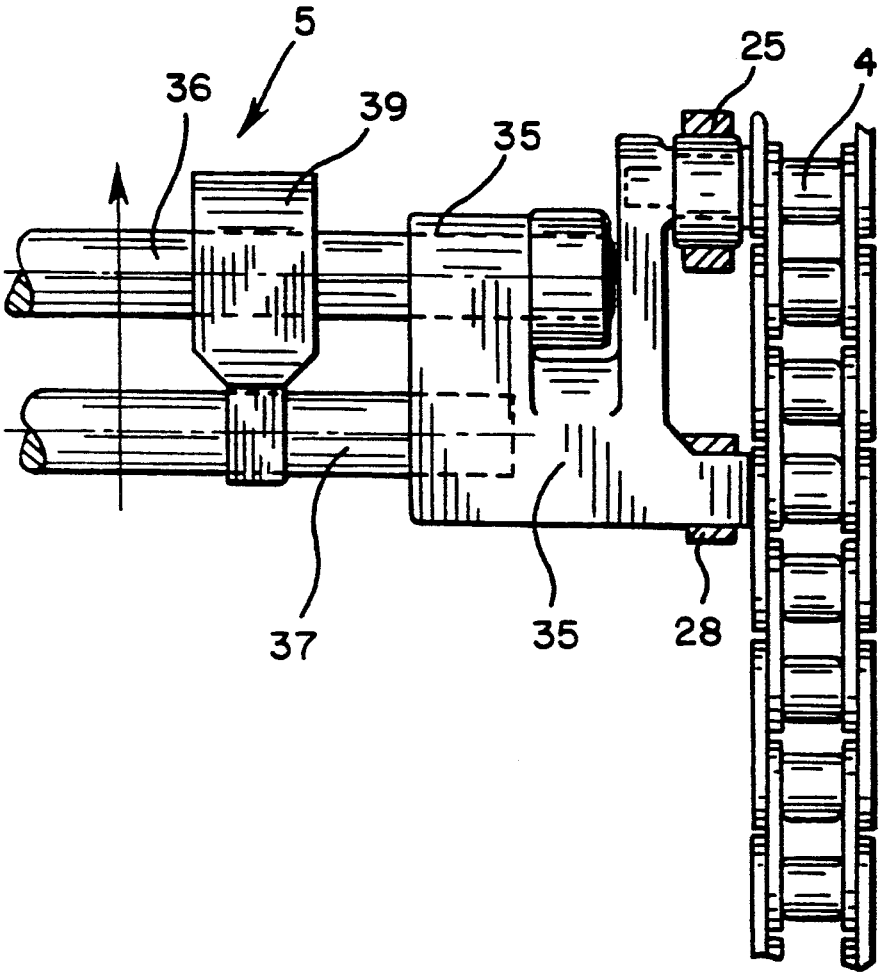
FIG. 3 is a section through a part of the chain-guided gripper carriage shown in FIG. 2 in a simplified form.

The operation of aligning and fixing the gripper carriages 5 on the impression cylinder 1 is so effected that as the chain 4 approaches, the support roller 24 acting as an alignment element and substantially in position A in FIG. 2 passes into the operative zone of the prism 25 acting as another alignment element and is aligned along the flank 26 thereof peripherally, i.e., tangentially with respect to the impression cylinder 1. Only then is the effective radius reached for the gripper supports 40 of the gripper carriages 5 as a result of the alignment surface 27 of the link 35 bearing on the radial support screws 28, which have to be adjusted to the sheet transfer position on assembly. By suitable selection of the path of the gripper carriages 5 it is possible to lengthen the alignment angle 12 and hence the time available for the aligning operation. This can also be achieved, for example, by the path of the gripper carriages 5 gradually approaching the periphery of the impression cylinder 1.

Tangential adjustment of the prisms 25 disposed on both sides in the direction of sheet feed and adjustable by set screws 31 enables the front edge of the sheet 38 to be so adjusted both in parallel and at an angle to the other printing units that correction of the position of the sheet 38 on the impression cylinders 1 also enables the different printed images to be brought into register with one another on the sheet 38 up to the complete printing of even those sheets 38 which have the maximum format, while, similarly, a lateral sheet position is also reproducibly adjustable, e.g., by lateral adjustments provided in the guide rails 33 or elsewhere.

When the operation of printing the sheet 38 is completed, the guide rails 33 guide the gripper carriages 5 connected to the chain 4 out of the periphery of the impression cylinder 1 after the carrier link 35 has been released at the correct time by means of the electromagnet 32 between the gripper carriage 5 and the impression cylinder 1, the release operation being effected by appropriate control system 45. The guide rails 33 may also be constructed as rollers or sprocket wheels or similar elements or a combination of such elements.

It will be understood that desired tensioning of the chain may be carried out at suitable places in the printing machine, the printing units being turned relatively to one another if necessary by via releasable couplings depending upon the amount of retensioning necessary. The gripper transfers of the printed sheet 38 from the sheet feeder 16 to the chain and from the latter to the delivery unit are controlled by stationary cams in a known manner.

We claim:

1. A sheet-fed printing machine for multi-colour printing comprising a plurality of printing units each having an impression cylinder and a blanket cylinder, said impression cylinders having a diameter of twice the diameter of the blanket cylinders, sprocket wheels fixed to opposite ends of said impression cylinders and also having a diameter twice the diameter of the blanket cylinders, chains cooperating with said sprocket wheels for movement through the printing units in arcuate paths, a plurality of sheet gripper carriages fixed to said chains for movement with said chains through said printing units, said chains including carrier links upon which said gripper carriages are supported, guide rails associated with said chains for guiding movement of said chains and the gripper carriages affixed thereto, gripper carriage locating and fixing devices disposed on diametrically opposed sides of said sprocket wheels for intermittently locking said gripper carriages in predetermined relation to said sprocket wheels and the associated impression cylinder, said locating and fixing devices each including first and second locating members, emans for tangentially adjusting the position of said first locating members relative to said sprocket wheels, means for radially adjusting the position of said second locating members relative to said sprocket wheels, and electromagnetic means operable upon passage of the carrier links over said locating and fixing devices for creating magnetic forces to draw the carrier links into engagement with the first and second locating members for locating the gripper carriage supported thereby in predetermined relation to the sprocket wheels and associated impression cylinder.

2. The sheet-fed printing machine of claim 1 in which each said first locating member is a prism that is tangentially adjustable relative to a respective sprocket wheel upon which it is mounted.

3. The sheet-fed printing machine of claim 2 in which each said second locating member includes a radially adjustable set screw.

4. The sheet-fed printing machine of claim 2 in which each said prism includes an outwardly extending locating groove, and each said carrier link has a locating support roller on the underside thereof for positioning in the prism groove upon movement of the carrier link onto the sprocket wheel.

5. The sheet-fed printing machine of claim 4 in which said prism groove is generally V-shaped.

6. The sheet-fed printing machine of claim 1 including means for actuating said electromagnetic means in timed relation to rotation of the sprocket wheel and impression cylinder.

* * * * *